US005371907A

United States Patent [19]

Horvath

[11] Patent Number: 5,371,907

[45] Date of Patent: Dec. 13, 1994

[54] POOL COVER SUPPORT

[76] Inventor: Leslie G. Horvath, 6184 Maxwell Dr., Madison, Ohio 44057

[21] Appl. No.: 51,988

[22] Filed: Apr. 26, 1993

[51] Int. Cl.[5] ..... E04H 4/06

[52] U.S. Cl. ..... 4/498

[58] Field of Search ..... 4/498, 503; 135/101, 135/103, 107

[56] References Cited

U.S. PATENT DOCUMENTS 3,461,890 8/1969 Goodrich ..... 4/498 X
4,122,562 10/1978 Sorrentino ..... 4/498
4,136,408 1/1979 Dahlbeck et al. ..... 4/498
4,951,327 8/1990 Del Gorio, Sr. ..... 4/498

*Primary Examiner*—Robert M. Fetsuga
*Attorney, Agent, or Firm*—E. Michael Combs

[57] ABSTRACT

A pool cover support for supporting an above-ground pool cover in an elevated position on a pool. The support includes a plurality of members that extend from a point above a center of the pool to sidewalls of the pool. The members rest upon the sidewalls and each member is secured to the sidewall with a clamp. The pool cover support further includes rollers mounted on each of the members to assist a user in applying a cover onto the support.

6 Claims, 4 Drawing Sheets

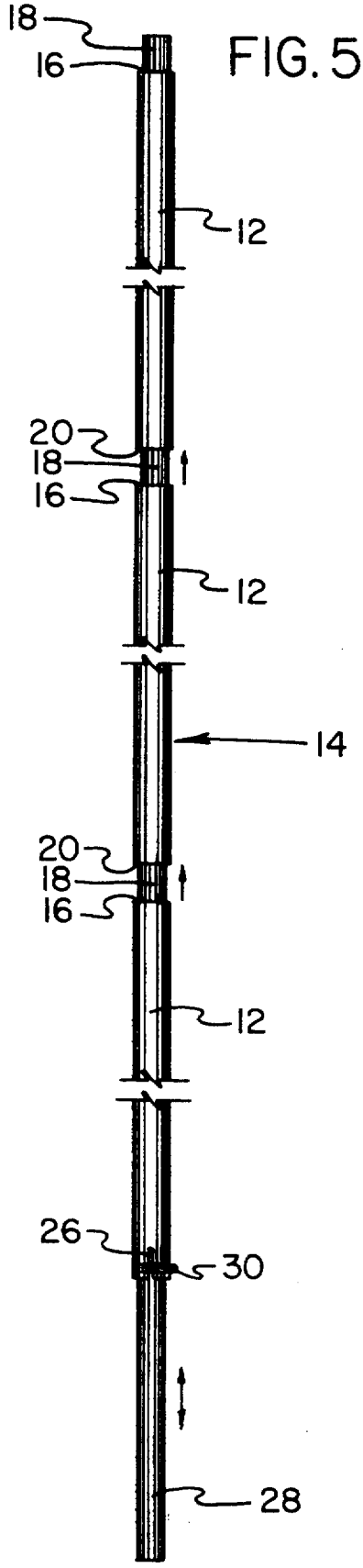
FIG. 5
FIG. 6
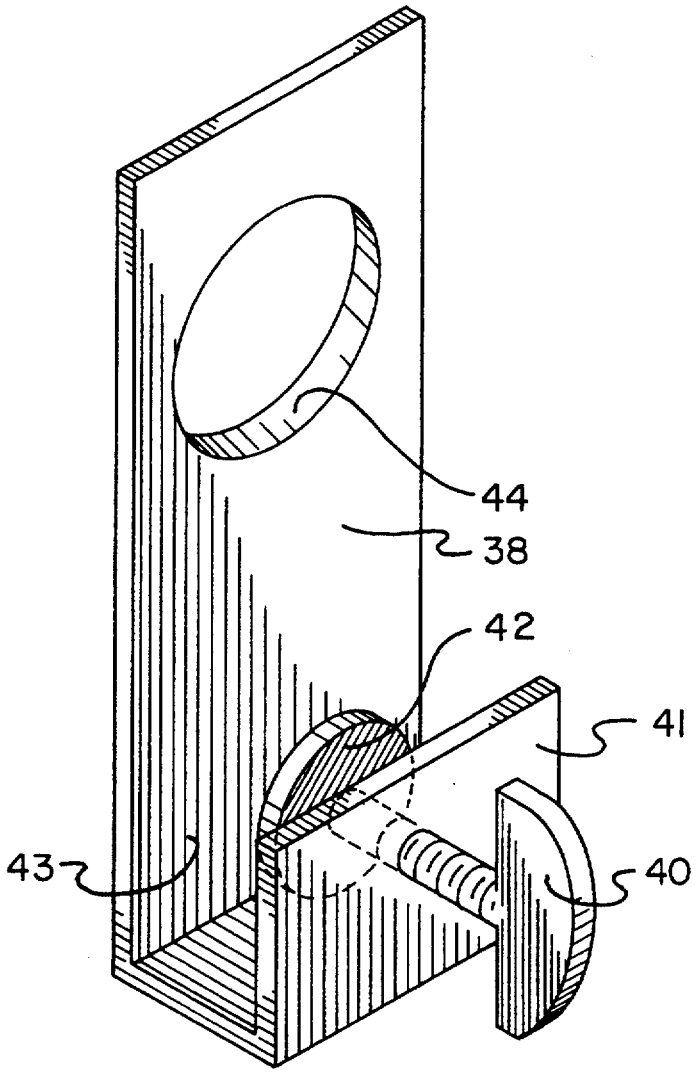
FIG. 7
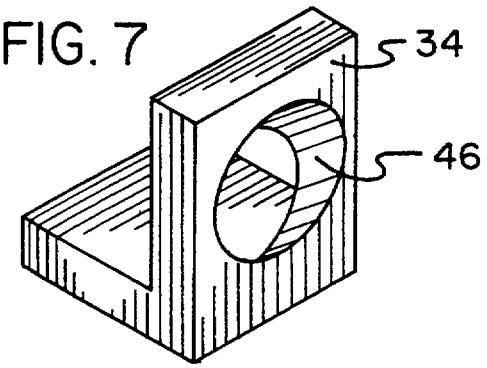

POOL COVER SUPPORT

BACKGROUND OF THE INVENTION

1. Field of the Invention

The present invention relates to support structures and more particularly pertains to pool cover supports which may be utilized for supporting an above-ground pool cover in an elevated position on a pool.

2. Description of the Prior Art

The use of pool cover support structure is known in the prior art. More specifically, pool cover support structures heretofore devised and utilized for the purpose of supporting pool covers are known to consist basically of familiar, expected and obvious structural configurations, notwithstanding the myriad of designs encompassed by the crowded prior art which have been developed for the fulfillment of countless objectives and requirements.

For example, a floating pool cover structure can be seen in U.S. Pat. No. 3,769,639 that utilizes a plurality of floatation blocks and supporting cables to support a structure upon which a cover may be placed.

A swimming pool cover floating support is illustrated in U.S. Pat. No. 4,000,527. This cover support includes a plurality of elongated floating elements such as inflated tube sections that float upon the surface of the pool and support a cover thereon.

A pool cover support system is disclosed in U.S. Pat. No. 4,951,327 which utilizes a central support member and a plurality of support arms. The central support member rests upon the bottom of the pool and is stabilized by the support arms. A cover may be disposed over the support and suspended thereby over the surface of the pool.

The pool cover support structures mentioned in the foregoing patents do not provide a support that substantially reduces the possibility of damage occurring to a pool liner by the support structure. Above-ground pools are constructed by placing a cylindrical pool wall upon a foundation and installing a vinyl liner within the pool wall to provide a sealed storage area for pool water. The vinyl liner is very fragile and may tear either upon abrupt physical contact or upon prolonged stress with an object or member. It is therefore important that a pool cover support does not contact the pool liner during periods of extreme weather conditions. It is equally important that a pool cover support does not place a concentrated stress upon any part of a pool liner.

Some of the prior art pool covers operate by supporting the cover with a member that rests upon the liner at the bottom of the pool. Bottom support type pool cover supports can place a high stress upon the liner and potentially cause the pool liner to fail. Other floating-type cover supports may be forced into contact with a pool liner during extreme weather conditions, possibly causing the pool liner to rupture. For example, a heavy snow may place an undesirably high amount of stress upon a bottom area of the liner or a high wind may force a floating support member into contact with the pool liner, thereby causing a split or tear therein.

A pool cover support that contacts water within the pool may not fully elevate the cover off of the pool water and will therefore cause undesirable depressions in the cover where puddles and the like may form. Furthermore, a cover or a structure that contacts the water in any way may interfere with surface and/or bottom cleaning devices that are used with a cover in place upon the pool.

Therefore, it can be appreciated that there exists a continuing need for a new pool cover support which can be utilized to support a pool cover in an elevated position while decreasing the possibility of liner damage occurring from contact of the pool cover support with a liner during extreme weather conditions. In this regard, the present invention substantially fulfills this need.

SUMMARY OF THE INVENTION

In view of the foregoing disadvantages inherent in the known types of pool cover support structures now present in the prior art, the present invention provides a new pool cover support construction wherein the same can be utilized to support a pool cover in an elevated position without structure that is in contact or may contact a pool liner. As such, the general purpose of the present invention, which will be described subsequently in greater detail, is to provide a new pool cover support apparatus and method which has many of the advantages of the pool cover support structure mentioned heretofore and many novel features that result in a pool cover support which is not anticipated, rendered obvious, suggested, or even implied by any of the prior art pool cover support structure, either alone or in any combination thereof.

To attain this, the present invention essentially comprises a pool cover support for supporting an above-ground pool cover in an elevated position on a pool. The support includes members that extend from a point above a center of the pool to sidewalls of the pool. The members rest upon the sidewalls of the pool and each member is secured to the sidewall with a clamp. The pool cover support further includes rollers mounted on each of the members to assist a user in applying a cover onto the support.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool cover support apparatus which has many of the advantages of the pool cover support structure mentioned heretofore and many novel features that result in a pool cover support which is not anticipated, rendered obvious, suggested, or even implied by any of the prior art pool cover support structure, either alone or in any combination thereof.

It is another object of the present invention to provide a new pool cover support which may be easily and efficiently manufactured and marketed.

It is a further object of the present invention to provide a new pool cover support which is of a durable and reliable construction.

An even further object of the present invention is to provide a new pool cover support which is susceptible of a low cost of manufacture with regard to both materials and labor, and which accordingly is then susceptible of low prices of sale to the consuming public, thereby making such pool cover supports economically available to the buying public.

Still yet another object of the present invention is to provide a new pool cover support which provides in the apparatuses and methods of the prior art some of the advantages thereof, while simultaneously overcoming some of the disadvantages normally associated therewith.

Still another object of the present invention is to provide a new pool cover support for supporting an above-ground pool cover in an elevated position on a pool.

Yet another object of the present invention is to provide a new pool cover support which may be utilized to support a pool cover with substantially no contact between the pool cover support and a pool liner during both normal operating conditions and extreme weather conditions.

Even still another object of the present invention is to provide a new pool cover support that includes rollers mounted thereon to assist a user in applying a cover onto the support.

Even still yet another object of the present invention is to provide a new pool cover support that may be readily disassembled and compactly stored when not in use.

These together with other objects of the invention, alone with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a side elevation view of a part of the pool cover support.

FIG. 6 is a perspective view of a further part of the pool cover support comprising the invention.

FIG. 7 is a perspective view of an even further part of the invention.

DESCRIPTION OF THE PREFERRED EMBODIMENTS

Figure 1:
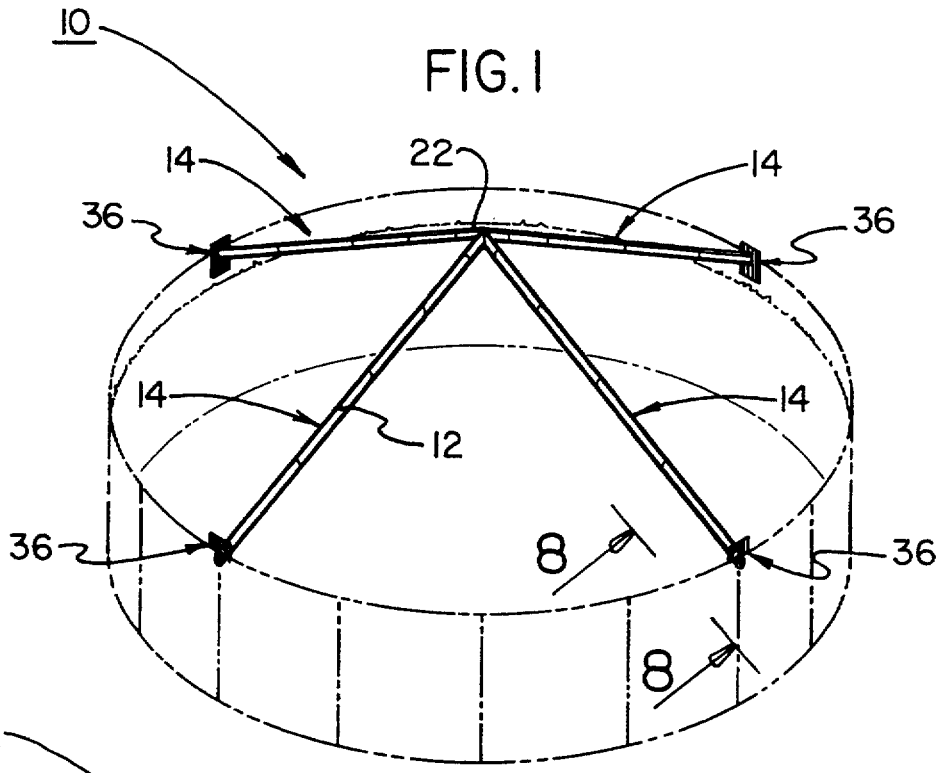
FIG. 1 is a perspective view of a pool cover support comprising the present invention as installed upon a pool.
Figure 2:
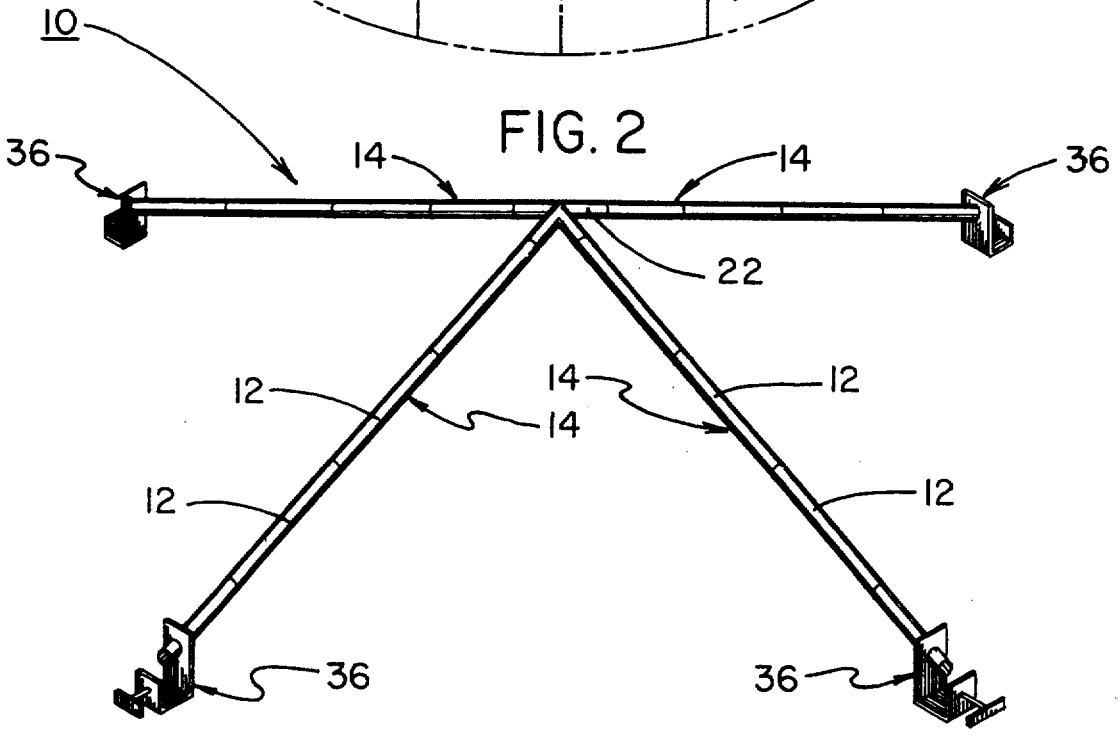
FIG. 2 is a perspective view of a pool cover support of the present invention per se.
Figure 3:
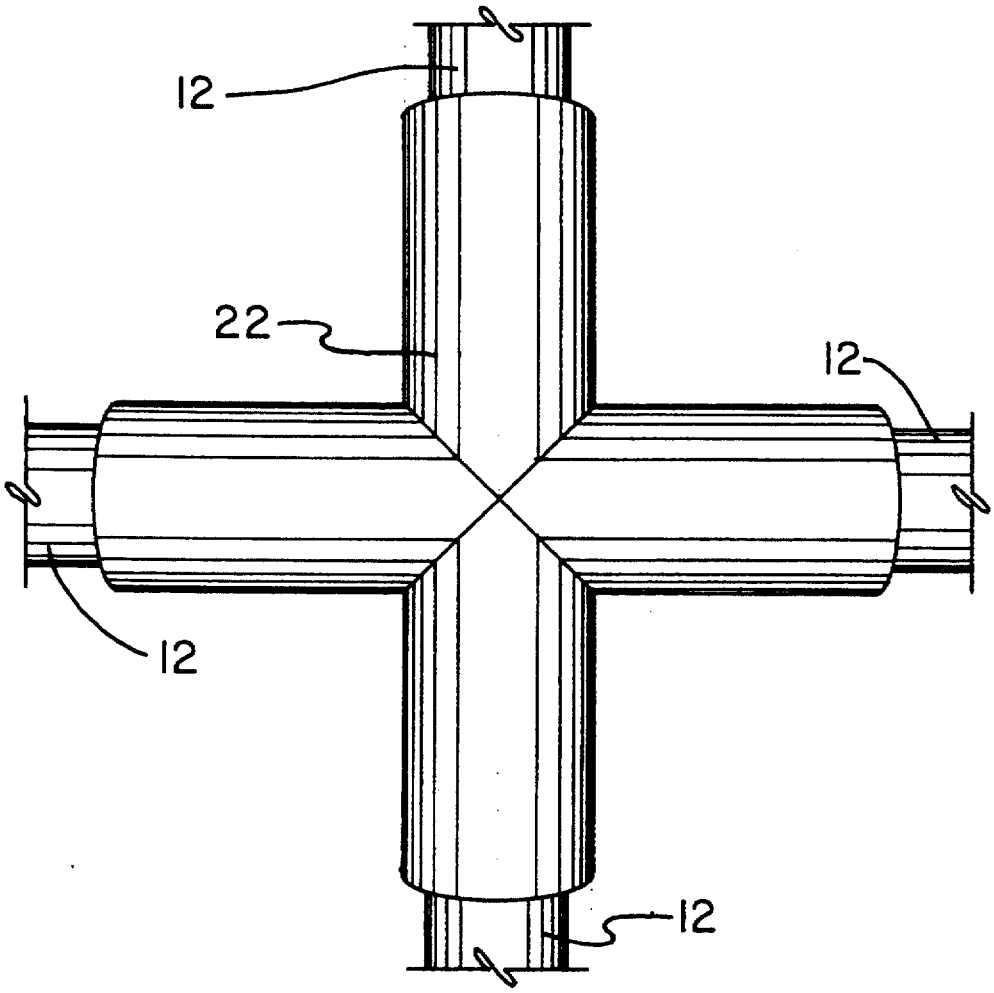
FIG. 3 is a top elevation view of a portion of the present invention.
Figure 4:
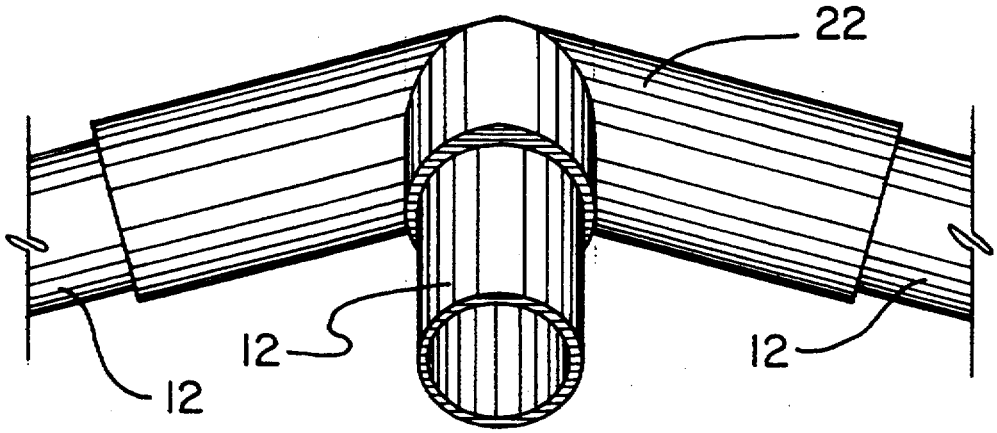
FIG. 4 is a side elevation view of a further portion of the invention.

With reference now to the drawings, and in particular to FIGS. 1–8 thereof, a first embodiment of a new pool cover support embodying the principles and concepts of the present invention and generally designated by the reference numeral 10 will be described.

More specifically, it will be noted that the first embodiment 10 of the present invention comprises a plurality of substantially tubular members 12 that may be selectively interlocked with each other to form a pole assembly 14. Each member 12 is formed to substantially define an elongated, hollow member of a circular cross sectional shape, although any conceivable cross sectional shape could be utilized. At a top end 16 of each member 12 is a projection 18 that is integrally formed or otherwise attached to the member which is of a proper size so as to allow the projection to be inserted into a lower end 20 of a substantially similar member to form the pole assembly 14. Although the members 12 are joined in this fashion, it should be realized that alternative methods of joining the members together may be utilized as well.

A plurality of the pole assemblies 14 are secured to a joiner 22 which fixedly secures each pole assembly thereto and allows each pole assembly to project both radially outward and downward at a slight angle from the horizontal to substantially define a flat cone structure. Each pole assembly 14 is secured to the joiner 22 in a manner similar to that used to join the plurality of members 12 together, although any conventional joining means may be used. The joiner 22 is formed in such a manner so as to allow the uppermost projection 18 of a pole assembly 14 to be captured within an aperture (not shown) of the joiner. Although any number of pole assemblies 14 may be joined together with an appropriate joiner to form the pool cover support 10, the joiner 22 shown in FIGS. 3–4 accepts and secures thereto four pole assemblies.

Figure 8:
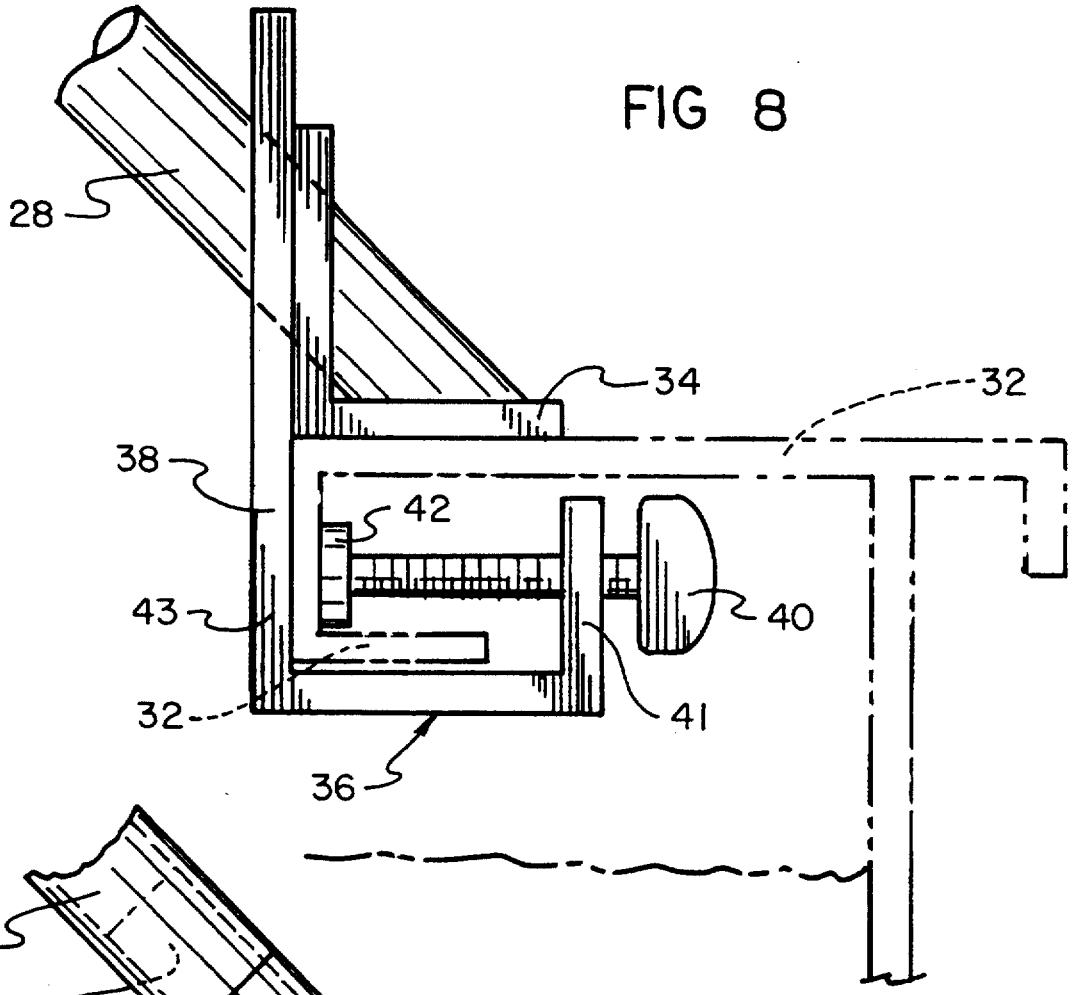
FIG. 8 is a cross sectional view taken along line 8—8 of FIG. 1.

At an end 24 of a member 12 of the pole assembly 14 opposite the joiner 22 is a slot 26. A rod 28 is partially slidably disposed within the member 12 having the slot 26 and may be secured in a desired position by a clamp 30 positioned over the slot. The slot 26 is operable to allow the clamp 30 to radially compress the member, thereby to secure the rod to the member 12 in a well understood manner. The rod 28 may be appropriately positioned to substantially extend or shorten the length of the pole assembly 14 to closely fit the pool cover support 10 to a pool to be covered. The pole assembly 14 concludes with the rod 28 being positioned upon a pool rail 32 and contacting the pool rail by resting upon a bushing 34. The rod 28 is then releasably secured to the pool rail 32 by a bracket assembly 36. The bracket assembly 36 comprises a substantially J-shaped bracket 38 that may be secured to the pool rail by a thumb screw 40 and a pressure pad 42. The thumb screw 40 is rotatably secured to a portion 41 of the bracket 38 and is operable to bias the pressure pad 42 against a further portion 43 of the bracket to substantially securely capture the pool rail 32 therebetween in a well understood manner. The rod 28 is secured to the bracket assembly 36 by an aperture 44 in the bracket 38 that allows the rod to pass therethrough. The bushing 34 has a substantially similar aperture 46 present therein that further allows the rod to pass therethrough, thereby to allow the assembly to be positioned upon a pool rail 32 as best shown in FIG. 8. Additional bracket assemblies 36 may be utilized to secure additional pole assemblies 14 to the pool rail 32 in a substantially similar manner as described above.

Figure 9:
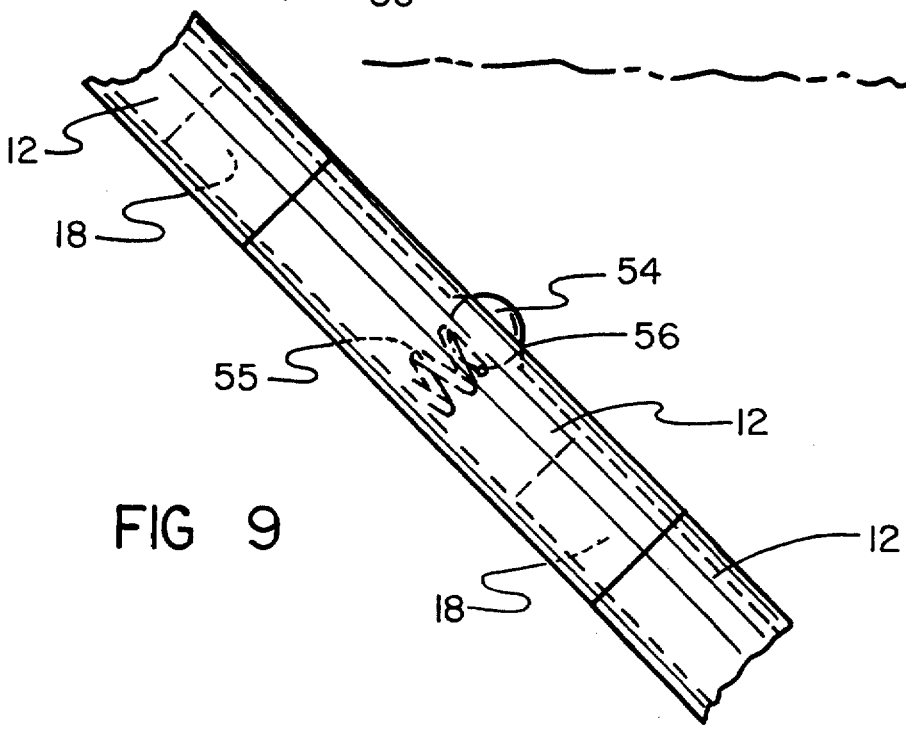
FIG. 9 is a side elevation view of an even further portion of the present invention.

A second embodiment 50 comprising all of the features of the foregoing embodiment 10 and an additional feature can be seen in FIG. 9 and will be described with concurrent reference to FIGS. 1–8. To facilitate the application of a pool cover onto the pool cover support 50 with less effort, at least one of the members 12 includes a roller assembly 52 that allows the cover to be easily advanced onto the pool cover support upon the roller assembly. A plurality of the roller assemblies 52 may be positioned upon the pool cover support 10. The roller assemblies 52 are all substantially identical in design and therefore only one will be described in detail. It can be shown that the roller assembly 52 as best shown in FIG. 9 comprises a substantially spherical ball 54 that is captured within one of the members 12. The ball 54 is biased by a spring 55 within the member 12 which causes a portion of the ball to project through an aperture 56 in the member. The ball 54 is rotatably supported by the spring 55 so that a pool cover may be easily advanced across the member by resting upon the ball 54 and rotating the ball in substantially any direction during a movement of the cover.

As to the manner of usage and operation of the present invention, the same should be apparent from the above description. Accordingly, no further discussion relating to the manner of usage and operation will be provided.

In summary, the pool cover support of the instant invention provides an apparatus that may be utilized to support a pool cover in an elevated relationship with a pool. The uniquely designed pool cover support allows conventional surface and/or bottom cleaning devices to be utilized without interference from the cover supporting structure. Because the support structure incurs substantially no contact with the associated pool liner, the potential of the pool sustaining damage to its fragile vinyl liner is greatly reduced. In addition, the pool cover support may be quickly disassembled and compactly stored when not in use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A pool cover support for attachment to a pool rail of a pool to support a cover in an elevated position over said pool, said support comprising:

a joiner;

a plurality of pole assemblies each having a first end and a second end, each of said pole assemblies being connected at said first end thereof to said joiner, each of said pole assemblies projecting radially outwardly and downwardly from said joiner to define a substantially flat cone structure;

a plurality of bracket means for releasably mounting said second end of each of said pole assemblies to said pool rail of said pool;

and, a plurality of roller assembly means mounted to each of said pole assemblies for movably supporting said cover relative to said pole assemblies during a sliding installation of said cover onto said pool cover support.

2. The pool cover support of claim 1, wherein each of said pole assemblies comprises a plurality of tubular members with each of said tubular members having a lower end and an upper end with a projection extending from said upper end, said projection being positionable within another lower end of another tubular member to couple said tubular members together.

3. The pool cover support of claim 2, wherein each of said tubular members has a sidewall with at least one roller aperture extending through said sidewall, and further wherein each of said plurality of roller assembly means comprises a spherical ball positioned within an individual one of said tubular members, with a spring positioned within said tubular member between said spherical ball and said sidewall to bias said spherical ball at least partially through said roller aperture.

4. The pool cover support of claim 3, wherein each of said bracket means comprises a substantially J-shaped member having a threaded aperture therethrough, and a threaded fastener engaged to said threaded aperture, said fastener being axially advancable to capture a portion of said pool rail between said substantially J-shaped bracket and said fastener.

5. A pool cover support for attachment to a pool rail of a pool to support a cover in an elevated position over said pool, said support comprising:

a support for supporting a pool cover thereon;

wherein said support comprises a plurality of pole assemblies connected together by a joiner at a point proximate a center of said pool;

wherein said plurality of pole assemblies comprises a plurality of members, said plurality of members being substantially similar in shape and being fastenable together by a connecting means comprising a projection fixedly secured to at least one of said plurality of members, said projection being engagable to at least one aperture present within another of said plurality of members, whereby at least two of said plurality of members may be connected together;

a rod slidably disposed in an end of at least one of said plurality of members, and a clamp engaged to said at least one member for radially compressing said at least one member to selectively secure said rod relative to said at least one member, thereby to allow a length of said at least one member to be selectively varied;

a securing means for securing at least one of said pole assemblies to a pool, said securing means comprising at least one bracket, said bracket being operable to releasably secure at least one of said plurality of pole assemblies to said pool rail;

wherein said bracket comprises a J-shaped member having an aperture extending therethrough, a fastener passing through said aperture and being threadably engaged to said substantially J-shaped member, whereby said fastener is rotatably axially advancable through said aperture to capture a portion of said pool rail between said J-shaped member and said fastener, said J-shaped member having a further aperture extending therethrough with a portion of said rod of said pole assembly passing through said further aperture to releasably secure said pole assembly to said pool rail;

a bushing, said bushing being positionable between an end of said rod and said pool rail so as to separate said rod from said pool rail;

and further comprising at least one roller assembly means mounted to each of said pole assemblies for movably supporting said cover relative to said pole assemblies during a sliding installation of said cover onto said pool cover support.

6. The pool cover support of claim 5, wherein each of said roller assembly means comprises a spherical ball positioned within an individual one of said members with said member having a sidewall and a one roller aperture extending through said sidewall, with a spring positioned within said tubular member between said spherical ball and said sidewall to bias said said spherical ball at least partially through said roller aperture.

* * * * *